US007165350B2

(12) United States Patent
Popikow

(10) Patent No.: US 7,165,350 B2
(45) Date of Patent: Jan. 23, 2007

(54) GUNLOCK SYSTEM FOR A MULTIPLE-BARREL FIREARM

(75) Inventor: Sergej Popikow, Weitnau (DE)

(73) Assignee: S.A.T. Swiss Arms Technology AG, Neuhausen (DE)

( * ) Notice: Subject to any disclaimer, the term of this patent is extended or adjusted under 35 U.S.C. 154(b) by 5 days.

(21) Appl. No.: 11/209,202

(22) Filed: Aug. 22, 2005

(65) Prior Publication Data

US 2006/0053672 A1 Mar. 16, 2006

(30) Foreign Application Priority Data

Aug. 25, 2004 (DE) ..... 10 2004 041 054

(51) Int. Cl.
*F41A 3/00* (2006.01)

(52) U.S. Cl. ..... 42/42.01; 42/69.01

(58) Field of Classification Search ..... 42/42.01, 42/42.02, 69.01, 41

See application file for complete search history.

(56) References Cited

U.S. PATENT DOCUMENTS 2,361,510 A 10/1944 Stout
4,091,556 A * 5/1978 Katsenes ..... 42/42.01
4,403,436 A 9/1983 Jennie
4,545,143 A * 10/1985 Schultz ..... 42/42.01
4,712,323 A * 12/1987 Masina ..... 42/42.01
6,796,067 B1 9/2004 Popikow

* cited by examiner

*Primary Examiner*—Michelle Clement
*Assistant Examiner*—Benjamin P. Lee
(74) *Attorney, Agent, or Firm*—Martin Fleit; Paul D. Bianco; Fleit Kain Gibbons Gutman Bongini & Bianco P.L.

(57) ABSTRACT

The invention pertains to a gunlock system for a multiple-barrel gun, with at least two hammers that are arranged in displaceable fashion on a basquill lock part, one respective hammer holder assigned to each hammer, and a trigger device that comprises sears assigned to the firing pins, a trigger and a selector mechanism, wherein the selector mechanism contains a selector element that can be displaced on the basquill lock part, and wherein a rocker that can be actuated by the trigger is movably arranged on the selector element. A pendulum mass arranged on the selector element is connected to the rocker in such a way that the distance between the rocker and the sears is increased during an excursion of the pendulum mass from a predetermined starting position under the influence the acceleration or deceleration of the selector element.

14 Claims, 9 Drawing Sheets

GUNLOCK SYSTEM FOR A MULTIPLE-BARREL FIREARM

FIELD OF THE INVENTION

The invention pertains to a gunlock system for a multiple-barrel firearm.

BACKGROUND OF THE INVENTION

A gunlock system of this type is known from DE 101 18 046 A1. This gunlock system contains two hammers that are arranged to slide on a lock plate and a trigger device that contains sears assigned to the hammers, a trigger and a selector mechanism for automatically connecting the trigger to the sear of the not-yet-released hammer after the first shot has been fired so that the second hammer can be released by the trigger. In order to create a versatile and highly reliable gunlock system, the selector mechanism contains a selector element that can be shifted in the longitudinal direction of the firearm and is provided with a pivotable rocker that is spaced apart from the sears in the cocked position of both hammers and not engaged with the sear of the second hammer so as not to fire the second shot until the first shot has been fired. Although this known gunlock system already provides adequate protection against double-firing, i.e., the unintentional firing of a second shot after the intentional firing of a first shot, it is always desirable to improve, particularly with respect to guns, the operational security and, simultaneously, to achieve a high level of dependability.

U.S. Pat. No. 2,361,510 A discloses a trigger mechanism for a double barreled firearm that comprises two pivotable hammers, two sears that are assigned to the hammers and a trigger that is connected to the sears. The connection between the trigger and the two sears is realized with the aid of a lever that can be displaced transverse to the trigger. Depending on its position, this lever engages beneath one or the other sear in order to release the corresponding hammer. For this purpose, the lever is arranged on the front end of a guide pin that is supported in an axially displaceable fashion in a bore of a selector element that can be displaced transverse to the trigger. The lever is pressed in the direction of the two sears with the aid of a compression spring that is arranged between the selector element and the lever. A recoil inertia block is fixed on the rear end of the guide pin that protrudes rearward relative to the guide part, wherein this recoil inertia block disengages the lever from the sears during the recoil that occurs when a shot is fired. However, the lever is disengaged from the sears only when the recoil inertia block moves rearward relative to the selector element in this case.

In a trigger mechanism known from U.S. Pat. No. 4,403,436 A, a selector mechanism is provided so that either barrel can be selected to be fired first. The trigger is connected to sears by means of a connector, which also serves as an inertia block and ensures that the second sear can be actuated by the trigger to fire a subsequent shot from the second barrel only after a shot has been fired from the first barrel.

EP 0 592 103 A1 discloses a gunlock for a double barreled shotgun with two pivotable hammers, sears assigned to the hammers, a trigger and a selector mechanism for selecting the firing sequence of the two barrels. The selector mechanism contains a manually adjustable selector plate that cooperates with a forked selector in order to selectively actuate the sear. The forked selector is pivotally mounted on a recoil inertia block that is connected to the trigger in articulated fashion.

SUMMARY OF THE INVENTION

The invention is based on the problem of additionally improving protection against the undesired double-firing in prior art gunlock systems.

This problem is solved with a gunlock system as claimed.

One significant advantage of the gunlock system according to the invention can be seen in that the protection against undesired double-firing is also ensured if the shooter does not shoulder the firearm correctly such that the acceleration phase of the firearm is excessively long during recoil. The pendulum mass provided on the selector element causes the rocker to be displaced rearward relative to the selector element during the acceleration phase as well as the deceleration phase of the firearm such that the distance between a front projection of the rocker and the sears is increased. This provides superior protection against unintentionally firing a second shot because the rocker cannot engage beneath the sears during the acceleration and deceleration phases of the firearm.

In the gunlock system according to the invention, the hammers and the firing pins can be linearly displaced in the longitudinal direction of the firearm such that the kinetic energy can be utilized as effectively as possible, while simultaneously achieving a compact design.

BRIEF DESCRIPTION OF THE DRAWINGS

Other details and advantages of the invention are discussed in the following description of a preferred embodiment with reference to the drawings. It shows.

DETAILED DESCRIPTION OF THE INVENTION

Figure 1:
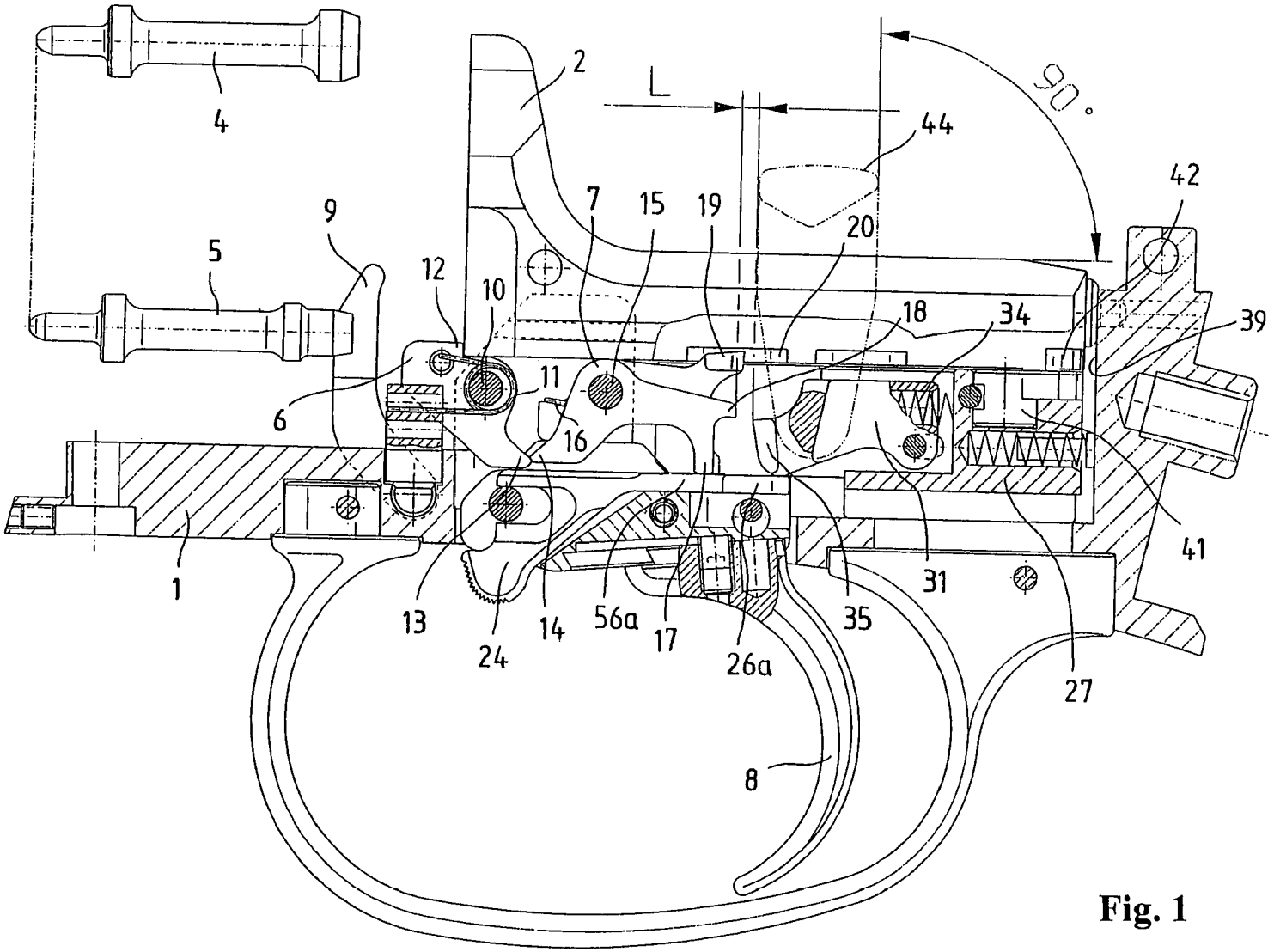
FIG. 1, a gunlock system of a double barreled drop barrel firearm in the cocked starting position before the first shot is fired.

FIGS. 1–5 show a gunlock system of a multiple-barrel shotgun in different positions. According to FIGS. 2–5, the gunlock system contains two adjacently arranged hammers 2 and 3 that are displaceably guided on a lower basquill lock part (lock plate) 1 and serve to actuate two firing pins 4 and 5 arranged one on top of the other. The two firing pins 4 and 5 are guided in an axially displaceable fashion in a not shown upper basquill lock part and are indicated only schematically in the figures.

Each hammer 2, 3 is acted upon by a firing pin spring and a corresponding hammer holder 6, which can be pivoted between a hold position and a release position, as well as a corresponding sear 7, which cooperates with the respective hammer holder. A trigger 8 makes it possible to pivot the sears 7 from a blocking position, from which it fixes the respective hammer holder 6 in its holding position, to a release position in which it releases the hammer holder 6 so that the respective hammer 2 or 3 is able to move forward. In its holding position, the hammer holder 6 holds the respective hammer 2 or 3 in its tensioned position. In its released position, the hammer holder 6 releases the respective hammer 2 or 3, subjected to the force of the firing pin spring, so that it is able to impact the respective firing pin 4 or 5 in order to fire a shot.

The displacement of the two hammers 2 and 3 into the tensioned position is respectively realized with the aid of a cocking lever 9 that is displaceably supported in the basquill lock part 1 and conventionally cooperates with a not shown drawbar in such a way that the hammers 2 and 3 are displaced into their cocked position by the drawbar and the corresponding cocking lever 9 when the barrel is dropped. FIGS. 1–5 show only the hammer holder 6 and the sear 7 of the hammer 2 provided for actuating the upper firing pin 4. A corresponding hammer holder and a corresponding sear are also provided for the hammer 3 shown in FIGS. 2–5.

According to FIG. 1, the hammer holder 6 is arranged on the lower basquill lock part 1 such that it can be pivoted about a first transverse pin 10 and pressed into its upper holding position by a coil spring 11. In the upper holding position of the hammer holder 6, the hammer 2 adjoins an upper locking edge 12 of the hammer holder 6 and is held in the cocked position by this locking edge. The hammer holder 6 also contains a lower locking projection 13 that is engaged with a front locking projection 14 of the sear 7 that is pivotable about a second transverse pin 15 in its blocking position. The sear 7 is pressed into its blocking position by a coil spring 16. On its rear end, the sear 7 contains a downwardly directed arm 17 and a rearwardly protruding projection 18. When the rear end of the sear 7 is raised, the front locking projection 14 is lowered and disengaged from the locking projection 13 of the hammer holder 6. This causes the hammer holder 6 to be released such that the hammer 2 is able to move forward under the influence of the firing pin spring. A catch blade 19 can be pivoted about a second transverse pin 15, wherein said catch blade engages in a corresponding recess 20 of the hammer 2 when the trigger 8 is not actuated and is not pivoted downward so as to release the hammer 2 until the rear end of the sear 7 is raised. This ensures that the hammer 2 is blocked when the trigger 8 is not actuated and that is released only when the trigger 8 is actually actuated. This makes it possible to realize an additional full security mechanism.

As mentioned above, the gunlock system also contains a corresponding set of the gunlock components described above with reference to the hammer 2 for the hammer 3. The hammer holder of the hammer 3 and the corresponding sear can also be pivoted about transverse pins 10 and 15, respectively.

Figure 2:
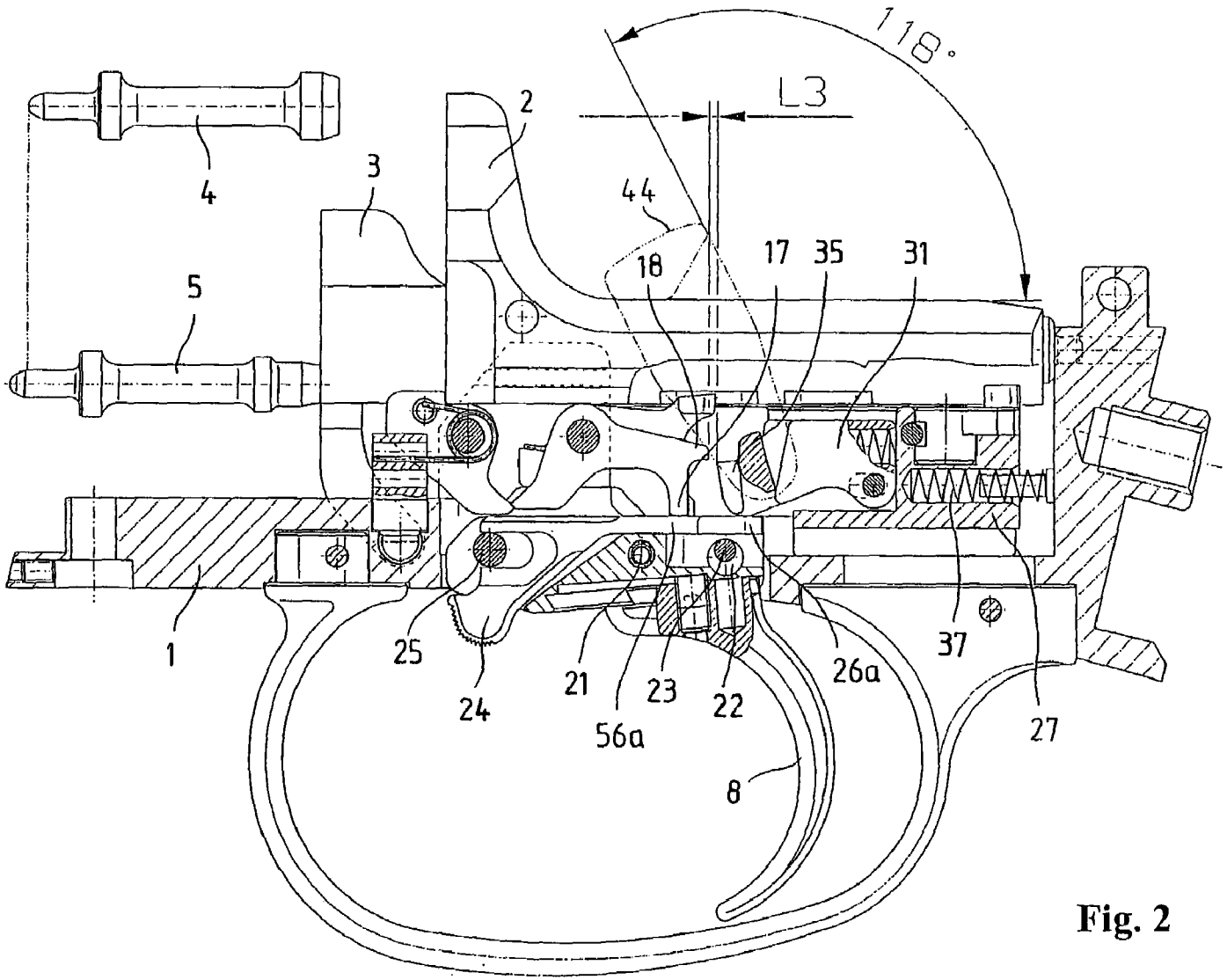
FIG. 2, the gunlock system according to FIG. 1 during recoil, wherein the acceleration increases and reaches its maximum after the first shot is fired.
Figure 9A:
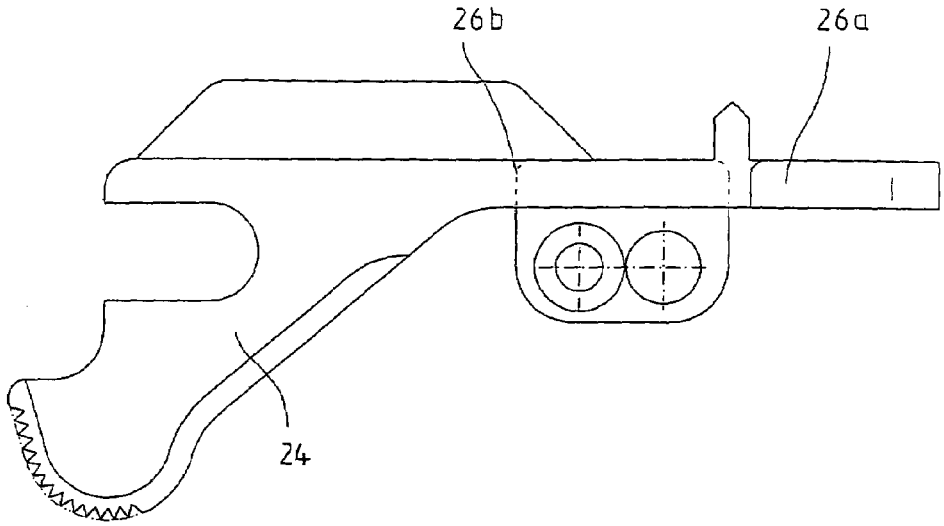
FIGS. 9*a, b*, a side view and a top view of the slide according to FIGS. 8*a, b.*
Figure 9B:
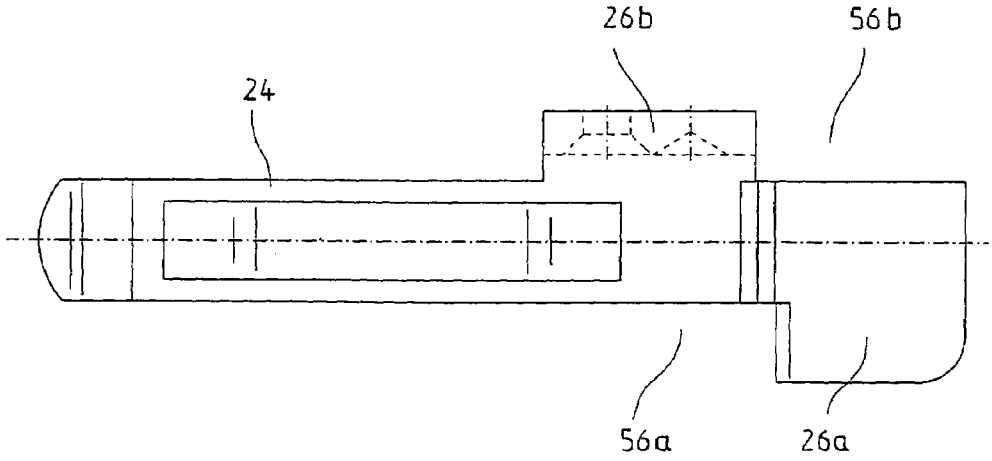

The trigger 8 according to FIG. 2 is arranged on the lower basquill lock part 1 such that it is movable about a trigger axis 21. On its rear end, the trigger contains a through bore 22 for holding a pin 23 that limits the movement of the trigger. On its front side, the trigger 8 contains a slide 24 that is guided by a guide pin 25 such that it can be moved in the longitudinal direction. The slide 24 is designed in such a way that it directly engages with the downwardly directed arm 17 of the sear 7 acting on the hammer 2 or the sear on the hammer 3, depending on its position. For this purpose, the slide 24 according to FIGS. 9*a*–*b* contains lateral arms 26*a*, 26*b* and recesses 56*a* and 56*b*. Consequently, it is possible to select whether the trigger 8 initially fires the cartridge in the upper or the lower barrel by adjusting the slide 24 accordingly.

Figure 8B:
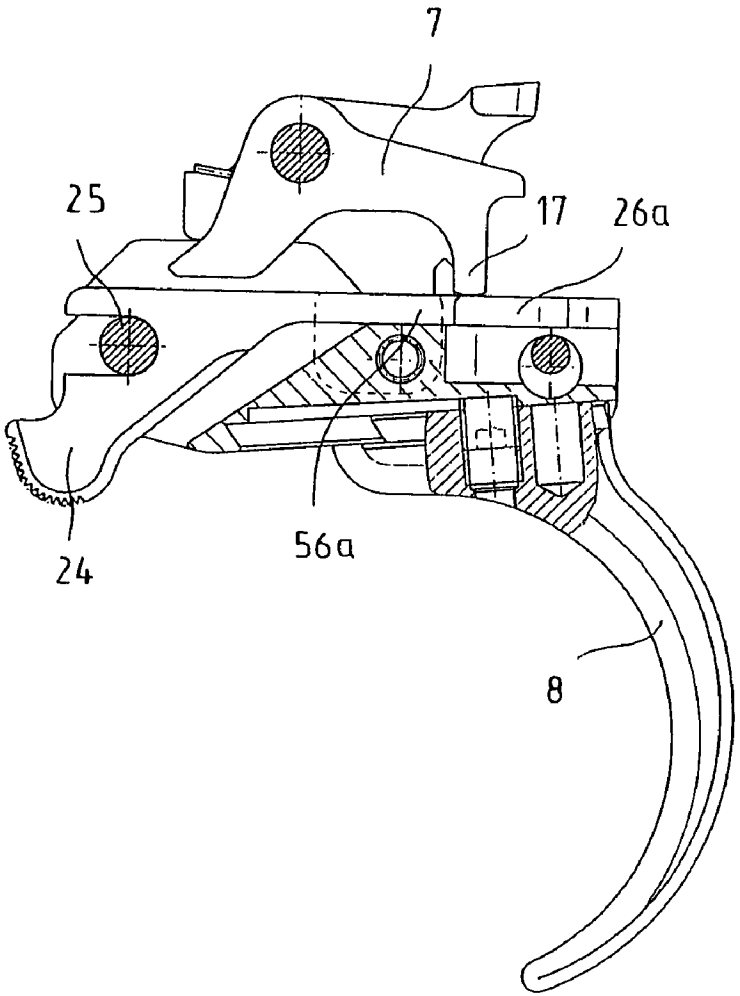
FIGS. 8*a, b*, a trigger with a slide in different positions.
Figure 8A:
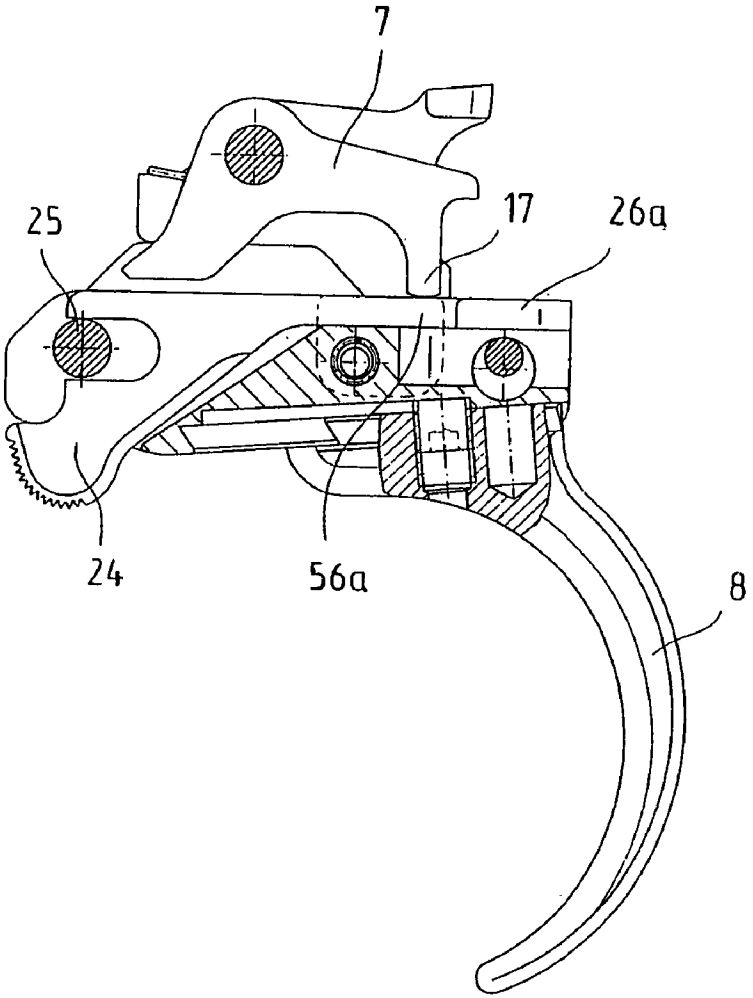

In the rear position of the slide 24 shown in FIG. 8*a*, the downwardly protruding arm 17 of the sear 7 acting on the hammer 2 engages in the recess 56*a* of the slide 24 when the trigger 8 is actuated. The downwardly protruding arm 17 of the sear acting on the hammer 3, in contrast, is in contact with the lateral arm 26*b* of the slide 24. When the trigger 8 is initially actuated, the rear end of the not shown sear acting on the hammer 3 is raised so as to release the hammer holder acting on it rather than [raising] the rear end of the sear 7 shown in the figure that serves for releasing the hammer holder 6 acting on the hammer 2. The sear releases the hammer holder such that the hammer 3 is able to impact the firing pin 5 assigned to the lower barrel under the influence of the firing pin spring. Therefore, the first shot is fired from the lower barrel in the position of the slide 24 shown in FIG. 8*a*.

However, if the first shot should be fired from the upper barrel, the slide 24 can be displaced into the front position shown in FIG. 8*b*. In this case, the downwardly protruding arm 17 of the sear 7 acting on the hammer 2 is in contact with the lateral arm 26*a* of the slide 24 while the corresponding arm of the other sear engages in the recess 56*b* of the slide 24. During the initial actuation of the trigger 8, the rear end of the sear 7 is raised by the lateral arm 26*a* so that the hammer holder 6 acting on the hammer 2 is released. Consequently, the hammer 2 is released in order to fire a shot from the upper barrel.

Figure 6A:
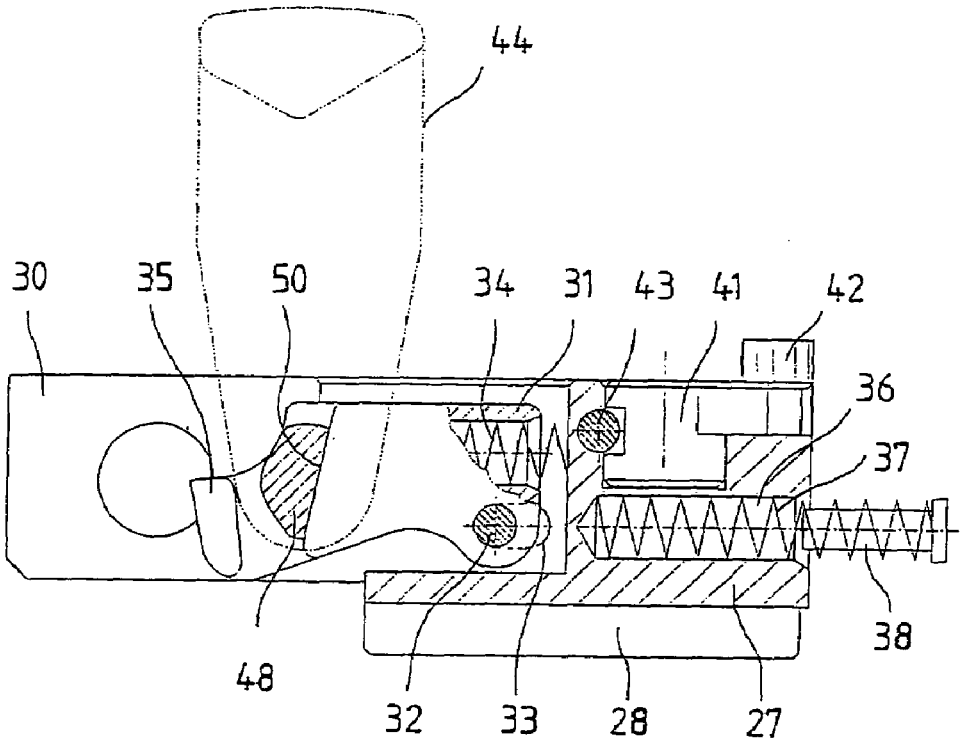
FIGS. 6*a, b*, a top view and a side view of a selector mechanism of the gunlock system according to FIGS. 1 5.
Figure 6B:
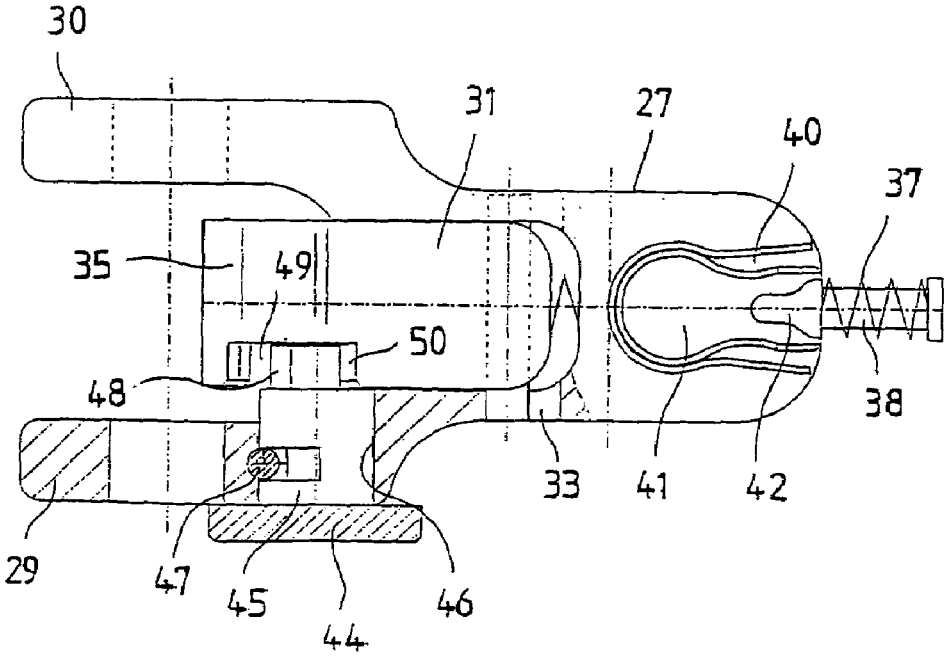
Figure 7A:
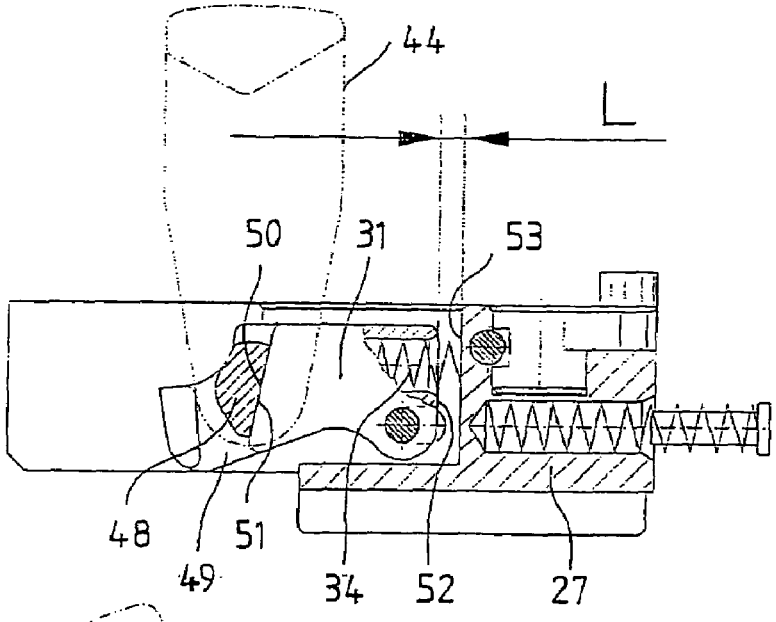
FIGS. 7*a, b, c,* different positions of the selector mechanism according to FIGS. 6*a, b;*

In order to automatically change over from one barrel to the other barrel after the first shot is fired, a selector mechanism, which is illustrated separately in FIGS. 6*a*, 6*b* and 7*a c* is arranged beneath the two hammers 2 and 3. According to FIGS. 6*a* and 6*b*, the selector mechanism contains a forked selector element 27 that is guided on a corresponding extension of the lower basquill lock part 1 such that it can be displaced in its longitudinal direction with the aid of a lower guide groove 28. The forked selector element 27 has two parallel legs 29 and 30, between which a rocker 31 is arranged such that it can not only be displaced in the longitudinal direction of the selector element 27, but also pivoted about a transverse axis 32. The transverse axis 32 is guided in a slot 33 that transversely extends through the selector element 27 so as to displace the rocker 31 in the longitudinal direction of the selector element 27. The rocker 31 is pressed forward by a compression spring 34. On its front end, the rocker 31 is provided with a projection 35 for engaging beneath the rearwardly protruding projections 18 of the two sears 7. The projection 35 shown in FIG. 1 adjoins the rear end of the slide 24 and is thus pressed upward when the trigger 8 is actuated.

The spring 37 is arranged in a blind bore 36 in the rear side of the selector element 27, with the rear end of said spring being supported on a rear wall 39 of the basquill lock part 1 by means of a guide pin 38, as shown in FIG. 1. A pin shaped selector part 41 with a wedge shaped pressure element 42 protruding upward from its rear end is arranged in a recess 40 on the upper side of the selector element 27 so that it can be displaced to either side by a certain angle. The selector part 41 is secured from falling out by means of a transverse pin 43. The wedge shaped pressure element 42 defines the position of the selector element 27 as a function of the position of the hammers 2 and 3, as described in greater detail below.

A pendulum mass 44 is coupled to the leg 29 of the selector element 27, so that it is able to swing back and forth. The pendulum mass 44 is shown by broken lines in the side view according to FIG. 6*a* and rotatably guided in a corresponding opening 46 of the leg 29 with the aid of a guide pin 45, which is illustrated in the top view according to FIG. 6*b*. The pendulum mass is axially secured by a pin 47. An inwardly protruding adjusting cam 48 is integrally formed onto the guide pin 45 and engages into a lateral recess 49 of the rocker 31.

Figure 7B:
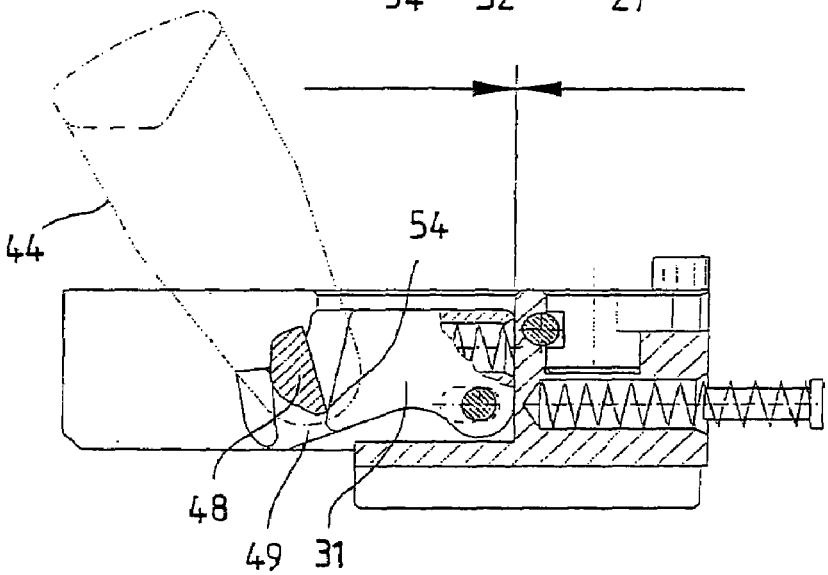
Figure 7C:
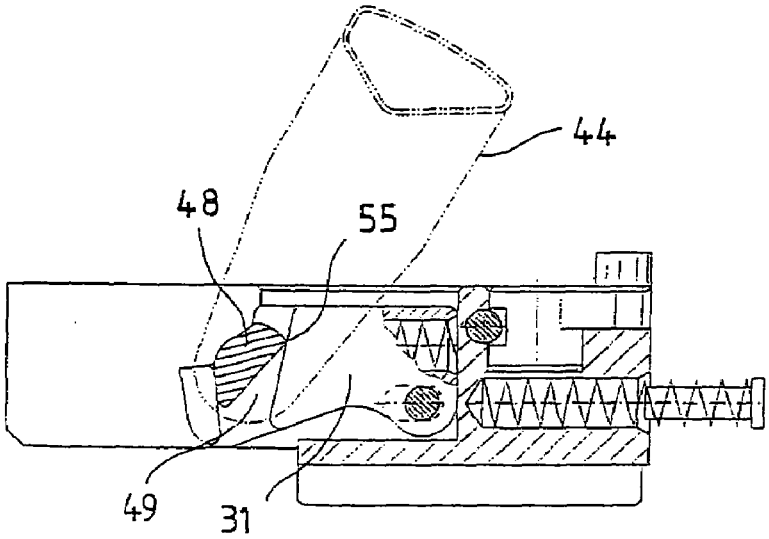

According to FIG. 7*a*, an oblique contact surface 50 is provided on the rear end of the recess 49, with an oblique mating surface 51 of the adjusting cam 48 adjoining this contact surface in its entirety when the pendulum mass 44 is in the vertical starting position shown in FIG. 7*a*. The oblique contact surface 50 and the oblique mating surface 51 are designed in such a way that the pendulum mass 44 is pressed into a predetermined vertical starting position by the rocker 31 that is pressed forward by the compression spring 34. In this position, a rear end face 52 of the rocker 31 is spaced apart from an inner contact surface 53 of the selector element 27 by a distance L. However, when the pendulum mass 44 swings forward or backward, the rocker 31 is pushed rearward against the force of the compression spring 34 until the rear end face 52 of the rocker 31 comes in contact with the inner contact surface 53 of the selector element 27. When the pendulum mass 44 swings forward as shown in FIG. 7*b*, the rocker 31 is moved rearward with the aid of the lower edge 54 of the adjusting cam 48. Although the pendulum mass 44 shown in FIG. 7*c* swings backward, the rocker 31 is moved rearward with the aid of the upper edge 55 of the adjusting cam 48.

The described gunlock system functions as described below:

When the firearm is cocked and the trigger 8 is not yet actuated, the above described components of the gunlock system according to the invention assume the position shown in FIG. 1. The hammer 2 and the not shown hammer 3 are held in their tensioned position by the respective hammer holders 6. The selector element 27 with the rocker 31 movably arranged thereon is also held in the tensioned position by the wedge shaped pressure element 42 of the selector part 41 that adjoins the rear side of the hammers 2 and 3. The compression spring 34 presses the pendulum mass 44 into the vertical starting position shown so that the rocker 31 assumes its front starting position relative to the selector element 27 as shown in the figure. In this position, the front projection 35 of the rocker 31 is spaced apart from the rear extension 18 of the sears 7 by a predetermined distance L, i.e., the rocker 31 and the sears 7 are not directly connected to one another.

When the trigger 8 is initially actuated, the rear end of the sear 7 acting on the hammer 2 or the rear end of the sear acting on the hammer 3 is raised first, depending on the position of the slide 24, by the respective lateral arms 26*a* and 26*b* of the slide 24. Here, the locking projection 14 situated on the front end of the sear 7 releases the corresponding hammer holder 6. In the tensioned position of the slide 24 shown in FIG. 1, the hammer 3 is released when the trigger 8 is initially actuated, and it acts on the lower firing pin 5, as shown in FIG. 2. When the hammer 3 moves forward under the influence of the firing pin spring, the selector part 41 of the selector element 27 that is pivotable to either side yields laterally such that the selector element 27 is able to move forward relative to the basquill lock part 1 under the influence of the spring 37, into the position shown in FIG. 5 in which the front projection 35 of the rocker 31 engages beneath the rear extension 18 of the sear 7. When the trigger 8 is actuated again, the rear end of the sear 7 is raised with the aid of the rocker 31 so that the hammer holder 6 acting on the hammer 2 is released. However, if the slide 24 is situated in the front position, the hammer 2 for actuating the upper firing pin 4 is released first when the trigger 8 is initially actuated. Subsequently, the selector part 41 yields to the other side and the selector element 27 is able to move forward under the influence of the spring 37.

The dynamic processes taking place in the selector mechanism for preventing a multiple-barrel firearm from double-firing, i.e., from unintentionally firing a second shot during the recoil movement of the firearm, are described below with reference to FIGS. 2 5.

FIG. 2 shows the gunlock system during recoil, where the acceleration increases until it reaches a maximum value. In this state, the selector element 27, which is pressed forward by the spring 37, is in contact with the lower basquill lock part 1. During the rearward acceleration, inertia causes the pendulum mass 44 to carry out a forward excursion such that the rocker 31 is displaced rearward relative to the selector element 27. When the pendulum mass 44 reaches its maximum forward excursion as shown in FIG. 2, the front projection 35 of the rocker 31 is spaced apart from the rear extension 19 of the two sears 7 by a distance L3, even if the selector element 27 is situated in the front position. This means that a second shot cannot be fired in this state.

Figure 3:
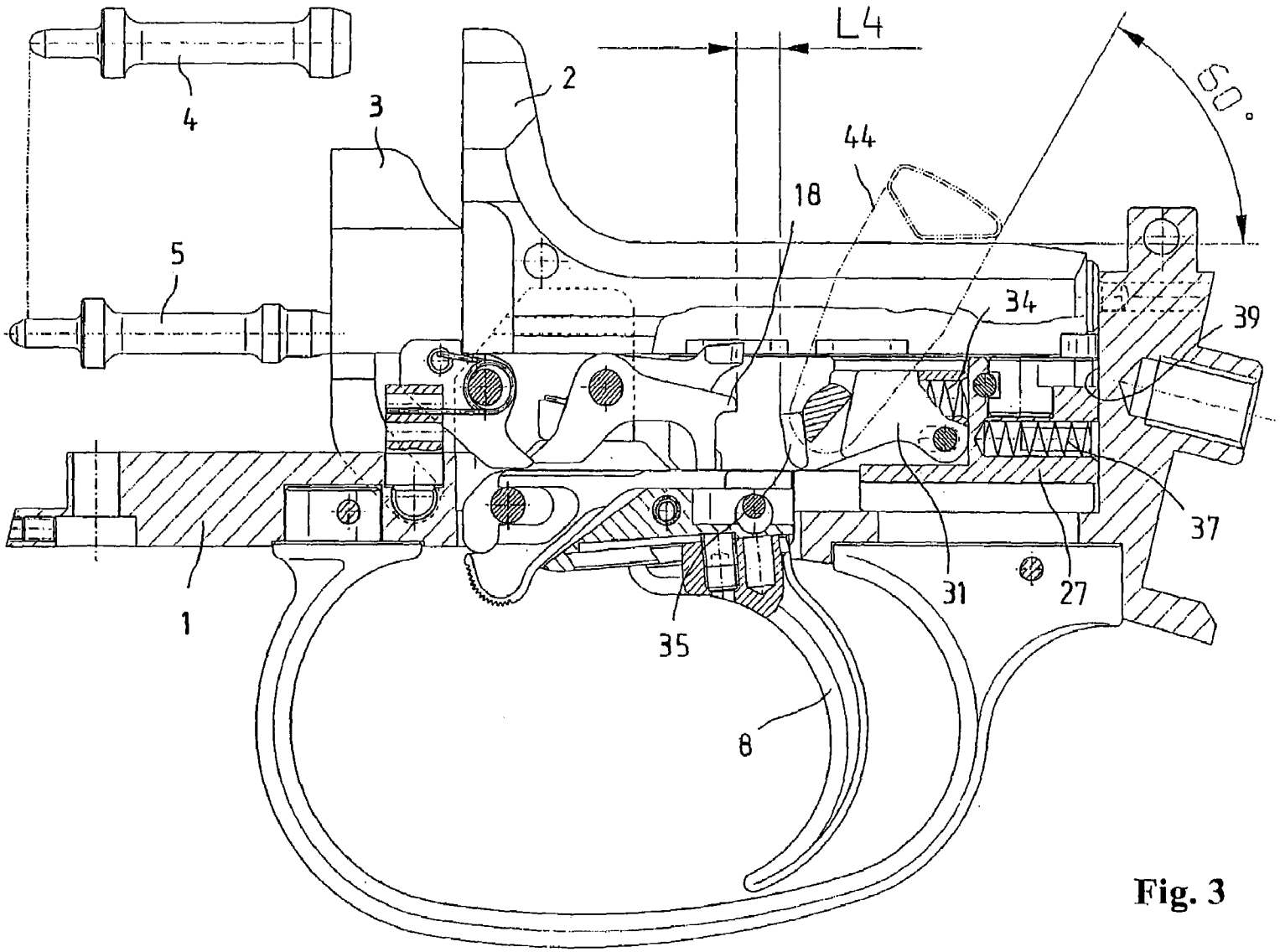
FIG. 3, the gunlock system according to FIG. 1 during the deceleration phase after the first shot is fired.

The deceleration of the firearm sets in after the acceleration is completed. This deceleration ensures that the selector element 27 shown in FIG. 3 is initially pressed against the rear wall 39 of the basquill lock part 1 against the force of the spring 37, and that the pendulum mass 44 subsequently carries out a backward excursion until its maximum backward excursion shown in FIG. 3 is reached. Consequently, the rocker 31 is also displaced rearward relative to the selector element 27 against the force of the spring 34 until it contacts the selector element 27. In this position, the front projection 35 of the rocker 31 is spaced apart from the rear extension 18 of the two sears 7 by a distance L4. This means that a second shot cannot also be fired in this state. The selector mechanism remains in this state until the restoring spring force exceeds the initial force of the selector mechanism.

Figure 4:
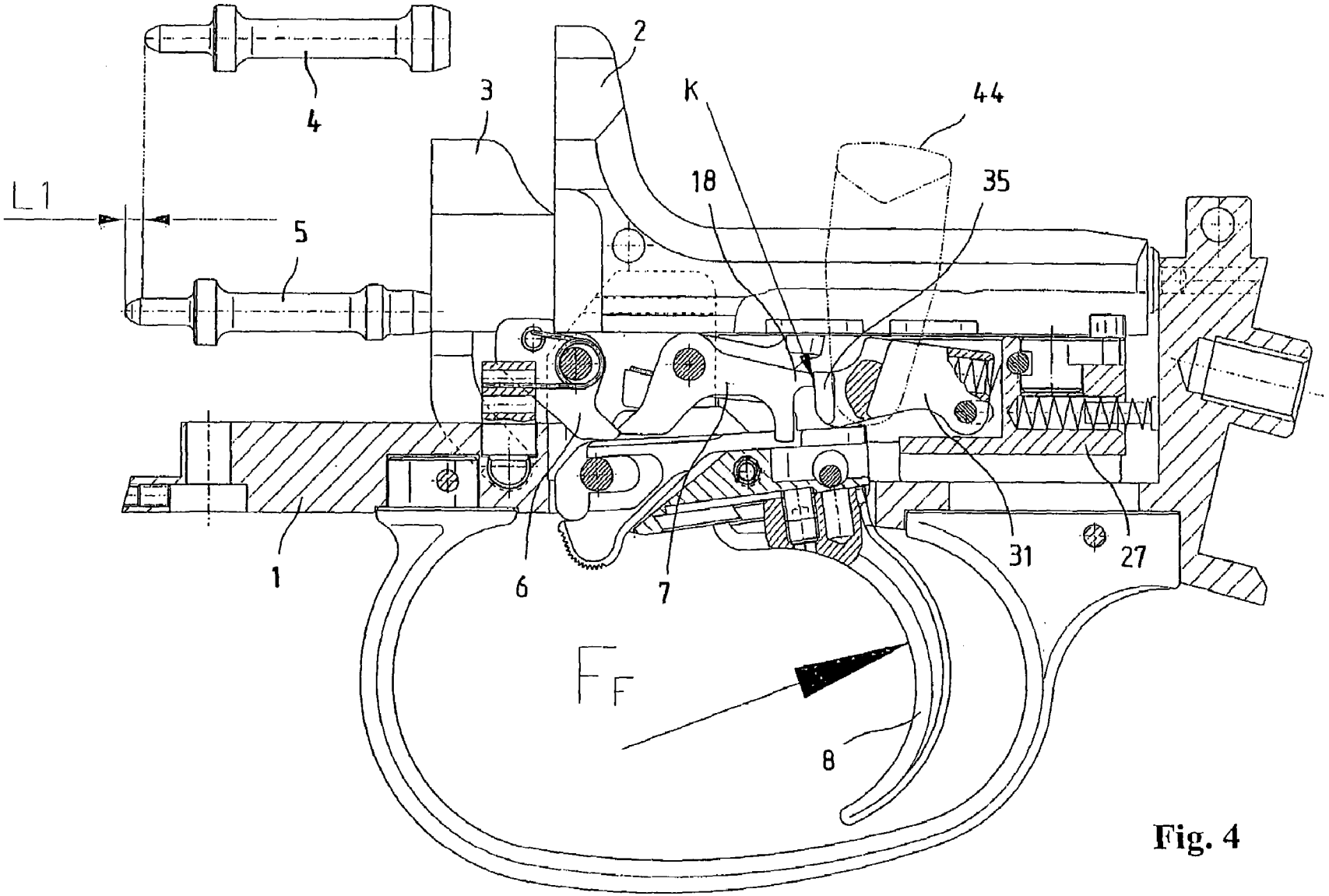
FIG. 4, the gunlock system according to FIG. 1 upon completion of the deceleration phase after firing the first shot.

After the deceleration phase is completed, the selector mechanism is once again displaced toward the front end position. If the trigger 8 is actuated during this process as shown in FIG. 4, the front projection 35 of the rocker 31 is unable to engage beneath the extension 18 of the sear 7, but rather is pressed against its rear edge, as indicated by the arrow K. The second hammer 2 cannot be released in this position. The front projection 35 of the rocker 31 is not able to engage beneath the extension 18 of the sear 7 in order to fire the second shot until the trigger 8 is released.

Figure 5:
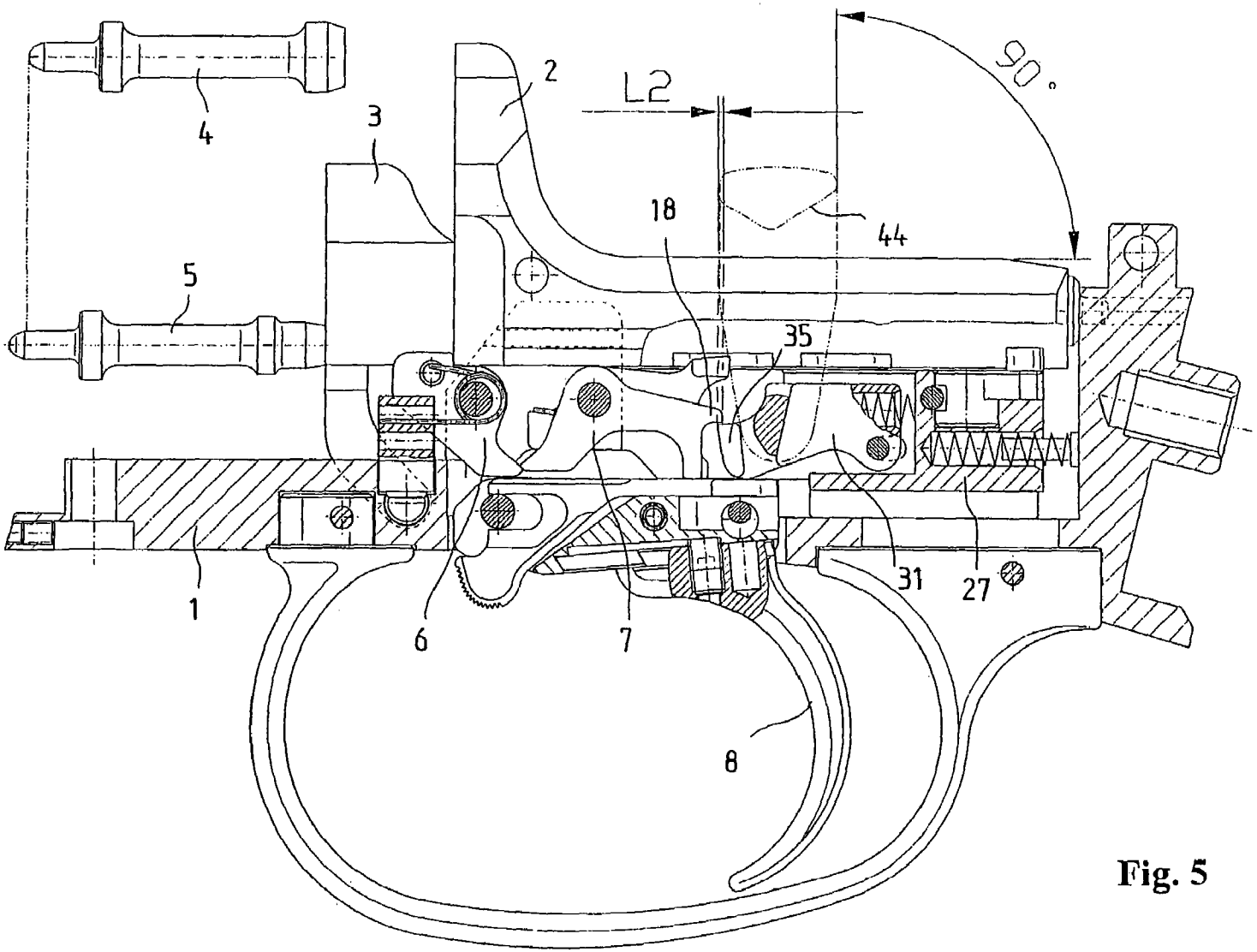
FIG. 5, the gunlock system according to FIG. 1 in the position for firing the second shot.

However, if the trigger 8 is not actuated when the deceleration phase is completed, the front projection 35 of the rocker 31 is able to engage beneath the extension 18 of the sear 7 as shown in FIG. 5. The sear 7 for firing the second shot can then be actuated with the aid of the rocker 31.

What is claimed is:

1. A gunlock system for a multiple-barrel firearm, with at least two hammers that are arranged in displaceable fashion on a basquill lock part, one respective hammer holder that is assigned to each hammer and serves to hold the hammers in a cocked position, and a trigger device that comprises sears assigned to the firing pins, a trigger and a selector mechanism for automatically connecting the trigger to the sear of the not yet-released hammer after the first shot has been fired, wherein the selector mechanism contains a selector element that can be displaced on the basquill lock part, wherein a rocker that can be actuated by the trigger is movably arranged on the selector element and spaced apart from the sears in the cocked position of both hammers, and wherein said rocker is not engaged with the sear acting upon the second hammer so as not to fire the second shot until the first shot has been fired, wherein a pendulum mass arranged on the selector element is connected to the rocker in such a way that the distance between the rocker and the sears is increased during an excursion of the pendulum mass from a predetermined starting position under the influence of acceleration or deceleration of the selector element.

2. The gunlock system according to claim 1, wherein the rocker is arranged in the selector element so that it can be displaced relative to the selector element and pivoted about a transverse axis.

3. The gunlock system according to claim 2, wherein the transverse axis of the rocker is displaceably guided in a slot extending through the selector element.

4. The gunlock system according to claim 1, wherein the pendulum mass is pressed into its predetermined starting position by the rocker that is pressed forward by a compression spring.

5. The gunlock system according to claim 1, wherein the rocker contains a front projection for engaging beneath rear extensions of the sears.

6. The gunlock system according to claim 1, wherein the pendulum mass is rotatably guided in a corresponding opening of the selector piece by means of a guide pin and is axially secured by a pin.

7. The gunlock system according to claim 1, wherein the pendulum mass contains an inwardly protruding adjusting cam that engages in a lateral recess of the rocker.

8. The gunlock system according to claim 7, wherein the adjusting cam has a lower edge and an upper edge that are displaced rearward by the rocker against the force of the compression spring when the pendulum mass carries out an excursion from the starting position.

9. The gunlock system according to claim 7, wherein the rocker contains an oblique contact surface that is contacted by an oblique mating surface of the adjusting cam.

10. The gunlock system according to claim 1, wherein a slide for selectively actuating one of the two sears is arranged on the trigger.

11. The gunlock system according to claim 1, wherein a selector part for controlling the forward movement of the selector element as a function of the displacement of the hammers is arranged on the selector element.

12. The gunlock system according to claim 11, wherein the selector part contains a wedge shaped pressure element for contacting the hammers.

13. The gunlock system according to claim 12, wherein the wedge shaped pressure element can be pivoted to either side by a predetermined angle from a center position.

14. The gunlock system according to claim 1, wherein the hammers can be displaced in the longitudinal direction of the firearm on the lower basquill lock part.

* * * * *

UNITED STATES PATENT AND TRADEMARK OFFICE

CERTIFICATE OF CORRECTION

PATENT NO. : 7,165,350 B2
APPLICATION NO. : 11/209202
DATED : January 23, 2007
INVENTOR(S) : Sergej Popikow It is certified that error appears in the above-identified patent and that said Letters Patent is hereby corrected as shown below:

Title Page #73, Line 2 under Assignee, Change "DE" to --CH --.

Signed and Sealed this

Twenty-fourth Day of April, 2007

JON W. DUDAS
*Director of the United States Patent and Trademark Office*